US009692165B2

(12) United States Patent
Matoba et al.

(10) Patent No.: US 9,692,165 B2
(45) Date of Patent: Jun. 27, 2017

(54) COAXIAL CONNECTOR

(71) Applicant: MURATA MANUFACTURING CO., LTD., Kyoto-fu (JP)

(72) Inventors: Ryo Matoba, Kyoto-fu (JP); Shogo Tokoi, Kyoto-fu (JP); Teppei Masago, Kyoto-fu (JP); Shingo Nakamura, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 14/625,153

(22) Filed: Feb. 18, 2015

(65) Prior Publication Data

US 2015/0162689 A1 Jun. 11, 2015

Related U.S. Application Data

(63) Continuation of application No. PCT/JP2013/071485, filed on Aug. 8, 2013.

(30) Foreign Application Priority Data

Aug. 24, 2012 (JP) ..... 2012-185735

(51) Int. Cl.
*H01R 9/05* (2006.01)
*H01R 13/405* (2006.01)
(Continued)

(52) U.S. Cl.
CPC ..... *H01R 13/405* (2013.01); *H01R 24/38* (2013.01); *H01R 24/46* (2013.01); *H01R 24/50* (2013.01); *H01R 9/0515* (2013.01); *H01R 29/00* (2013.01)

(58) Field of Classification Search
CPC ..... H01R 24/50; H01R 9/0515; H01R 29/00
(Continued)

(56) References Cited

U.S. PATENT DOCUMENTS 5,535,455 A * 7/1996 Liu ..... E03C 1/26 4/286
6,666,699 B2 * 12/2003 Uratani ..... H01R 24/46 439/188
(Continued)

FOREIGN PATENT DOCUMENTS

CN 1728473 2/2006
EP 2366520 A1 9/2011
(Continued)

OTHER PUBLICATIONS

International Search Report; PCT/JP2013/071485; Nov. 12, 2013.
Written Opinion of the International Searching Authority; PCT/JP2013/071485; Nov. 12, 2013.

*Primary Examiner* — Dac D Ta
*Assistant Examiner* — Nader Alhawamdeh
(74) *Attorney, Agent, or Firm* — Studebaker & Brackett PC

(57) ABSTRACT

A coaxial connector is manufactured to have a structure in which a first resin member is not easily separated from an external terminal. A coaxial connector according to the present disclosure includes a first resin member, a second resin member attached to the first resin member, a fixed terminal and a movable terminal disposed between the first resin member and the second resin member, and an external terminal attached to outer peripheries of the first resin member and the second resin member. The external terminal includes a cylindrical accommodating portion that accommodates the first resin member, and the first resin member includes a resin engagement portion. The resin engagement portion is engaged with the accommodating portion, so that separation of the first resin member is prevented.

6 Claims, 15 Drawing Sheets

(51) Int. Cl.
*H01R 24/46* (2011.01)
*H01R 24/50* (2011.01)
*H01R 24/38* (2011.01)
*H01R 29/00* (2006.01)

(58) Field of Classification Search
USPC ..... 439/581, 188
See application file for complete search history.

(56) References Cited

U.S. PATENT DOCUMENTS 6,751,317 B2 * 6/2004 Shima ..... H01R 13/7033 379/438
6,783,374 B2 * 8/2004 Uratani ..... H01R 9/0515 439/188
6,808,405 B1 * 10/2004 Uratani ..... H01R 13/7037 439/188
6,843,673 B1 * 1/2005 Liu ..... H01R 24/46 439/188
6,932,615 B1 * 8/2005 Yeo ..... H01R 24/46 439/63
6,939,152 B1 * 9/2005 Chen ..... H01R 13/703 439/188
7,118,383 B2 * 10/2006 Nagata ..... H01R 13/6315 439/581
8,038,450 B2 * 10/2011 Nakagawa ..... H01R 24/50 439/188
8,066,516 B2 * 11/2011 Hoshiba ..... H01R 24/44 439/63
8,113,857 B1 * 2/2012 Huang ..... H01R 24/46 439/188
8,235,750 B2 * 8/2012 Osaki ..... H01R 13/6315 439/188
8,678,859 B2 * 3/2014 Hirakawa ..... H01R 4/028 439/188
2001/0050983 A1 * 12/2001 Shima ..... H01R 13/7033 379/188
2002/0009912 A1 * 1/2002 Uratani ..... H01R 24/46 439/188
2006/0024985 A1 2/2006 Nagata et al.
2006/0128195 A1 * 6/2006 Chen ..... H01R 24/46 439/188
2010/0130028 A1 * 5/2010 Hoshiba ..... H01R 24/44 439/63
2010/0227481 A1 * 9/2010 Liao ..... H01R 24/46 439/63
2013/0303008 A1 * 11/2013 Hida ..... H01R 13/703 439/188
2014/0227906 A1 * 8/2014 Hoshiba ..... H01R 24/46 439/578

FOREIGN PATENT DOCUMENTS

JP H02-37470 U 3/1990
JP 2002-042991 A 2/2002
JP 2006-026984 A 2/2006
JP 2011-194604 A 10/2011
WO 2009/157220 A1 12/2009

* cited by examiner

COAXIAL CONNECTOR

CROSS REFERENCE TO RELATED APPLICATIONS

This application claims benefit of priority to Japanese Patent Application No. 2012-185735 filed Aug. 24, 2012, and to International Patent Application No. PCT/JP2013/071485 filed Aug. 8, 2013, the entire content of each of which is incorporated herein by reference.

TECHNICAL FIELD

The present technical field relates to a coaxial connector having a switching function for switching a signal path.

BACKGROUND

A coaxial connector having a switching function for switching a signal path is mounted on a circuit board disposed in a mobile communication device, such as a mobile phone.

For example, Japanese Unexamined Patent Application Publication No. 2002-42991 describes a coaxial connector 101 illustrated in FIG. 15. The coaxial connector 101 includes an external terminal 130, a first resin member 110, a second resin member 120, a fixed terminal 140, and a movable terminal 150.

According to Japanese Unexamined Patent Application Publication No. 2002-42991, the coaxial connector 101 is manufactured by the following manufacturing method.

First, the movable terminal 140 and the fixed terminal 150 are disposed between the first resin member 110 and the second resin member 120. Next, a projecting portion 111 of the first resin member 110 is fitted to an accommodating portion 131 of the external terminal 130. Then, leg portions 133 of the external terminal 130 are bent so that the entire body is secured.

SUMMARY

Technical Problem

As illustrated in FIG. 15, in the coaxial connector 101 described in Japanese Unexamined Patent Application Publication No. 2002-42991, the projecting portion 111 of the first resin member 110 has a straight shape and is parallel to the direction in which the first resin member 110 is fitted.

Therefore, after the first resin member 110 has been fitted to the accommodating portion 131 of the external terminal 130, if vibration or the like is externally applied before the next manufacturing step, there is a risk that the first resin member 110 will be separated from the external terminal 130.

As a result, a defective product in which no first resin member 110 is included may be produced, or a manufacturing apparatus may be stopped to deal with the separation of the first resin member 110. Thus, the production efficiency is reduced.

Accordingly, an object of the present disclosure is to provide a coaxial connector with which the first resin member is not easily separated from the external terminal in a manufacturing process of the coaxial connector.

Solution to Problem

A coaxial connector according to the present invention includes a first resin member having a through hole for receiving a center conductor of a mating coaxial connector, and a second resin member attached to the first resin member so as to cover one end of the through hole.

The coaxial connector further includes a fixed terminal disposed between the first resin member and the second resin member, and a movable terminal disposed between the first resin member and the second resin member, the movable terminal being capable of coming into contact with and separating from the fixed terminal.

The coaxial connector further includes an external terminal attached to outer peripheries of the first resin member and the second resin member without covering the other end of the through hole so as to be electrically connectable to an outer conductor of the mating coaxial connector.

The external terminal includes a cylindrical accommodating portion that accommodates the first resin member, and the first resin member includes a resin engagement portion that is engaged with the accommodating portion.

With the above-described coaxial connector, the resin engagement portion of the first resin member is engaged with the accommodating portion of the external terminal. Therefore, even when vibration or the like is externally applied in the manufacturing process of the coaxial connector, the first resin member is prevented from being separated from the external terminal.

Preferably, the resin engagement portion includes a slope or a step.

In this case, the resin engagement portion easily engages with the accommodating portion of the external terminal, and the separation of the first resin member can be effectively prevented.

In addition, preferably, the external terminal includes a terminal engagement portion at a position where the resin engagement portion is engaged, the terminal engagement portion having a shape that matches a shape of the resin engagement portion.

In this case, the surface of the terminal engagement portion matches the surface of the resin engagement portion, and the engagement area is increased. Therefore, the separation of the first resin member can be more effectively prevented.

In addition, preferably, the external terminal includes a dent or a projection in a region other than the accommodating portion, and the first resin member includes a resin projection that matches the dent or a resin dent that matches the projection at a position corresponding to the dent or the projection.

In this case, the first resin member can be prevented from being rotated with respect to the external terminal.

In addition, preferably, the first resin member is formed by insert molding by using the external terminal as an insert member.

In this case, even when the outer dimensions of the external terminal vary due to individual differences, the first resin member can be formed in a shape that follows the shape of the external terminal. Therefore, the separation of the first resin member can be reliably prevented.

Advantageous Effects of Invention

According to the present disclosure, the resin engagement portion of the first resin member is engaged with the accommodating portion of the external terminal. Therefore, even when vibration or the like is externally applied in the manufacturing process of the coaxial connector, the first resin member is prevented from being separated from the external terminal.

DETAILED DESCRIPTION

A coaxial connector 1 according to an embodiment of the present disclosure has a switching function for switching a signal path.

Figure 1:
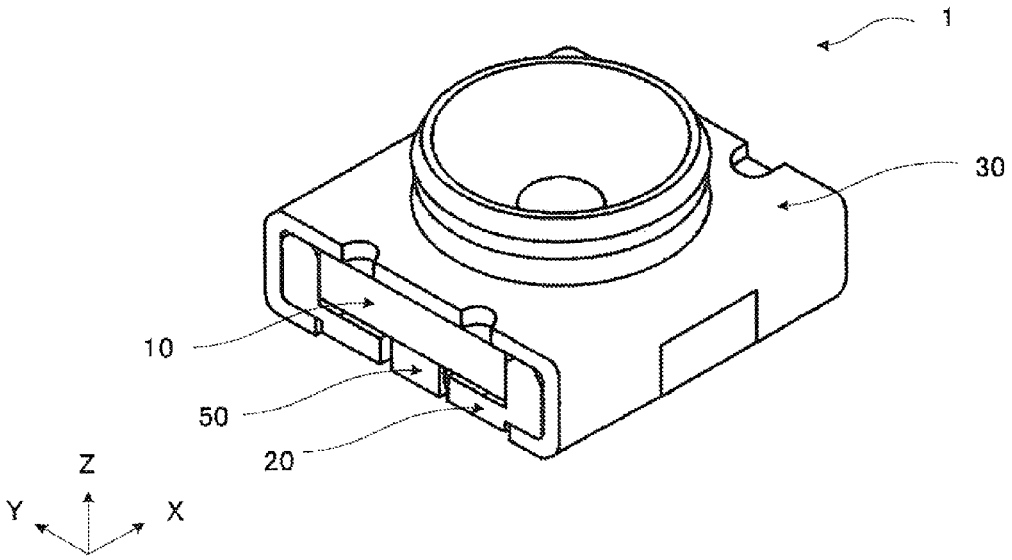
FIG. 1 is a perspective view of a coaxial connector 1 according to an embodiment of the present disclosure.
Figure 2:
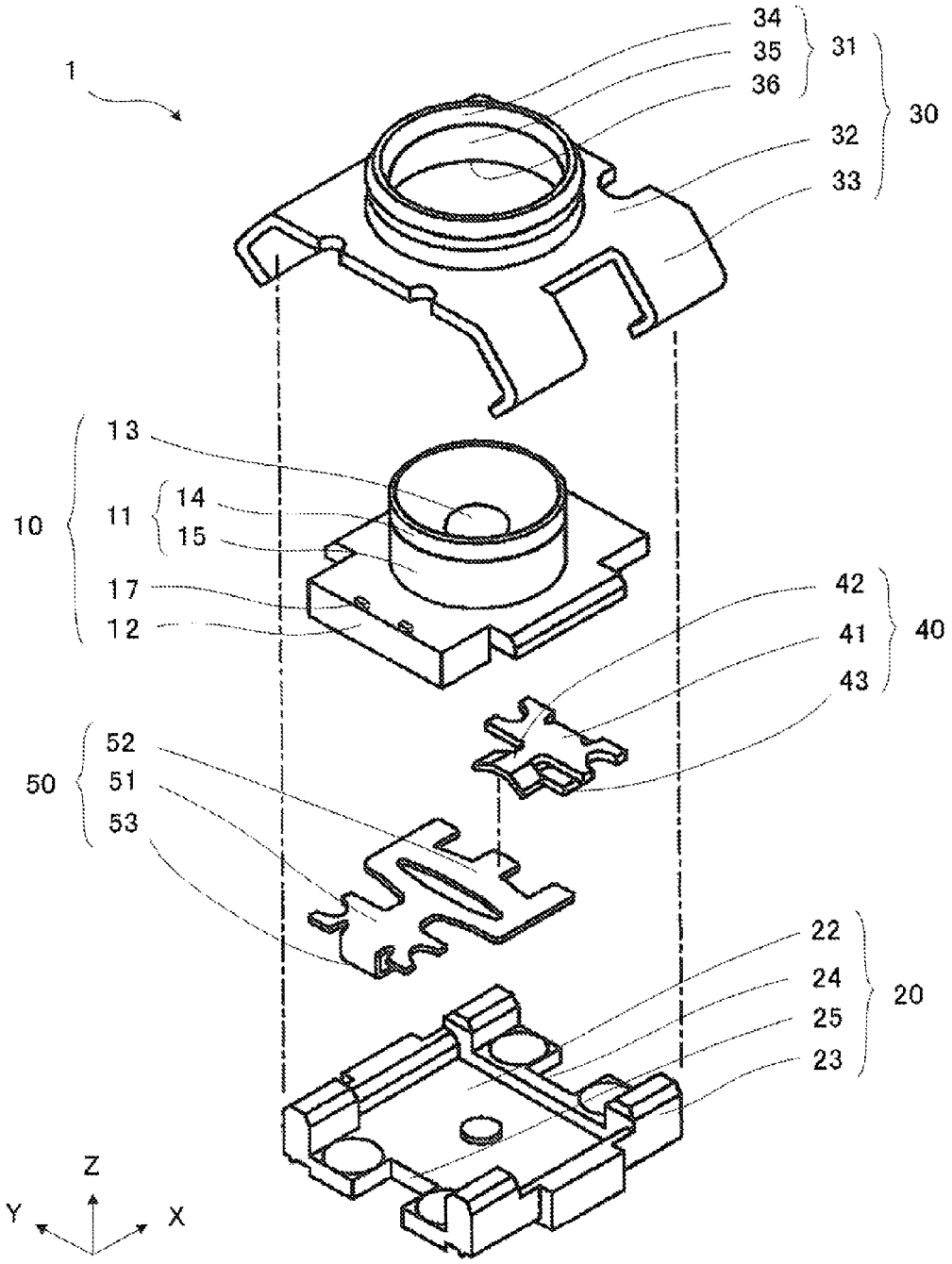
FIG. 2 is an exploded perspective view of the coaxial connector 1 illustrated in FIG. 1.
Figure 3:
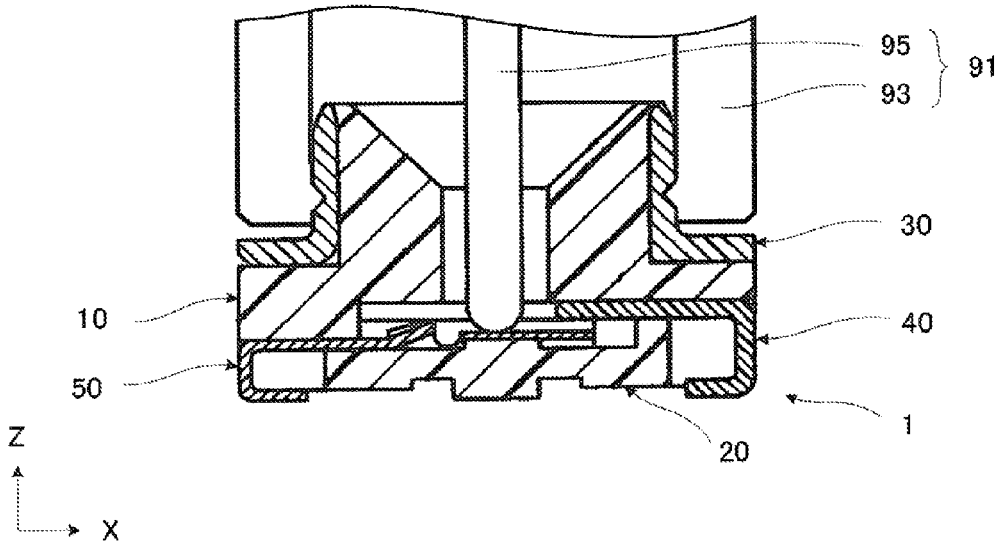
FIG. 3 is a sectional view of the coaxial connector 1 illustrated in FIG. 1, illustrating the state in which a mating coaxial connector 91 is connected to the coaxial connector 1.

As illustrated in FIG. 3, in the state in which the mating coaxial connector 91 is attached to the coaxial connector 1, a center conductor 95 of the mating coaxial connector 91 is electrically connected to a movable terminal 50 disposed in the coaxial connector 1. In addition, an outer conductor 93 of the mating coaxial connector 91 is electrically connected to an external terminal 30 of the coaxial connector 1.

In this case, by using the mating coaxial connector 91 as a measurement probe, the electrical characteristics of an electronic circuit to which the coaxial connector 1 is attached can be measured.

Figure 4:
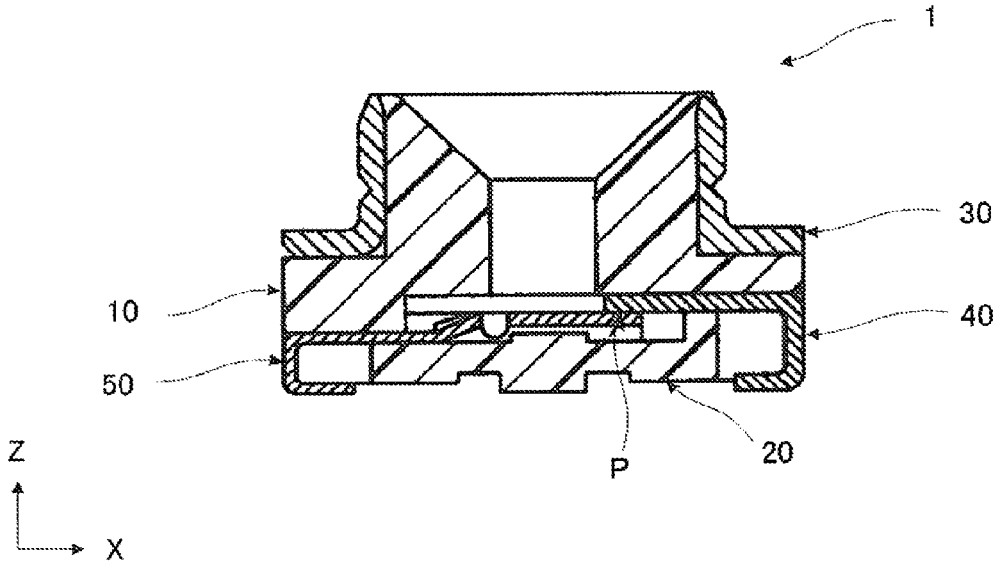
FIG. 4 is a sectional view of the coaxial connector 1 illustrated in FIG. 1, illustrating the state in which the mating coaxial connector 91 is not connected to the coaxial connector 1.

As illustrated in FIG. 4, in the state in which the mating coaxial connector 91 is not attached to the coaxial connector 1, the movable terminal 50 of the coaxial connector is moved in the direction shown by arrow P and is electrically connected to a fixed terminal 40. Thus, a signal path is switched in the coaxial connector 1.

As illustrated in FIGS. 1 to 4, in the coaxial connector 1, the fixed terminal 40 and the movable terminal 50 are disposed between a first resin member 10 and a second resin member 20. Also, the external terminal 30 is attached to outer peripheries of the first resin member 10 and the second resin member 20.

The coaxial connector 1 according to the present embodiment is characterized in that the first resin member 10 is not easily separated from the external terminal 30 in the manufacturing process of the coaxial connector 1.

The structure and manufacturing method of the coaxial connector 1 will now be described.

In FIGS. 1 to 10, the direction in which the first resin member 10 and the second resin member 20 are attached to the external terminal 30 is referred to as a Z direction, the direction in which the fixed terminal 40 and the movable terminal 50 are arranged is referred to as an X direction, and the direction orthogonal to the Z and X direction is referred to a as a Y direction.

Figure 5:
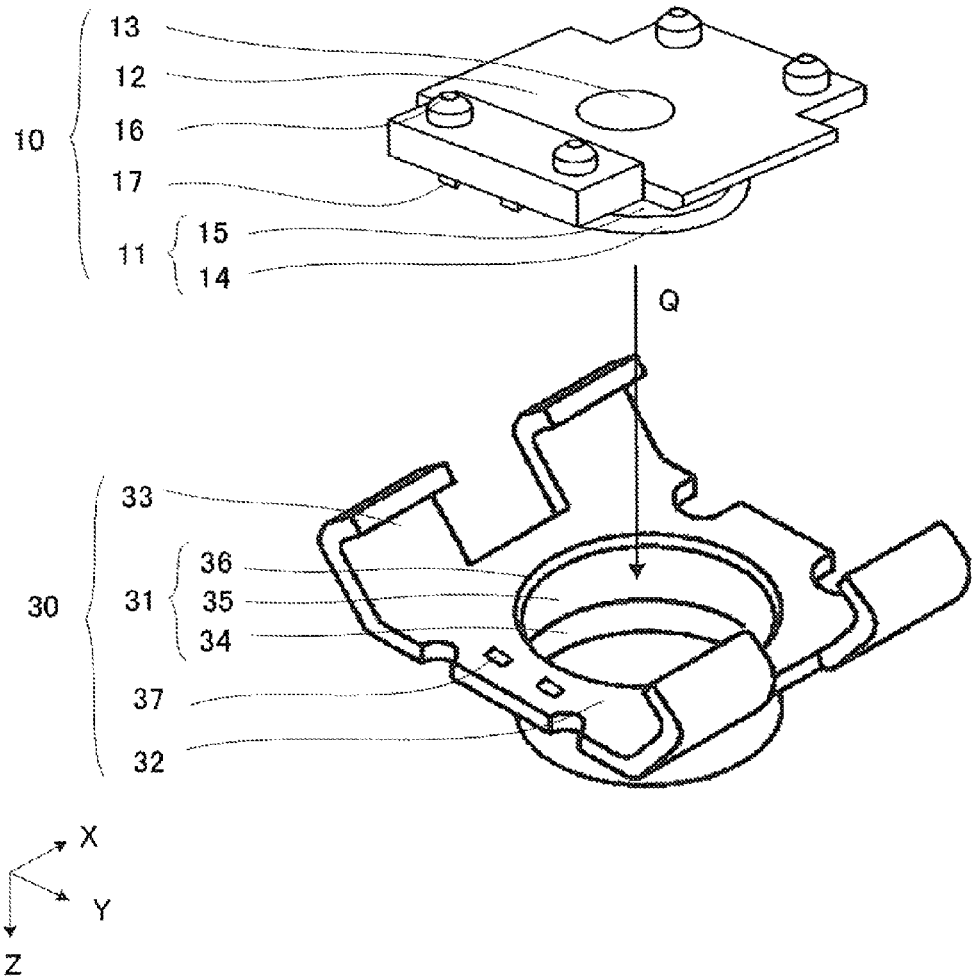
FIG. 5 is a perspective view illustrating a step of a manufacturing method of the coaxial connector 1 of FIG. 1, illustrating the state before a first resin member 10 is attached to an external terminal 30.
Figure 9:
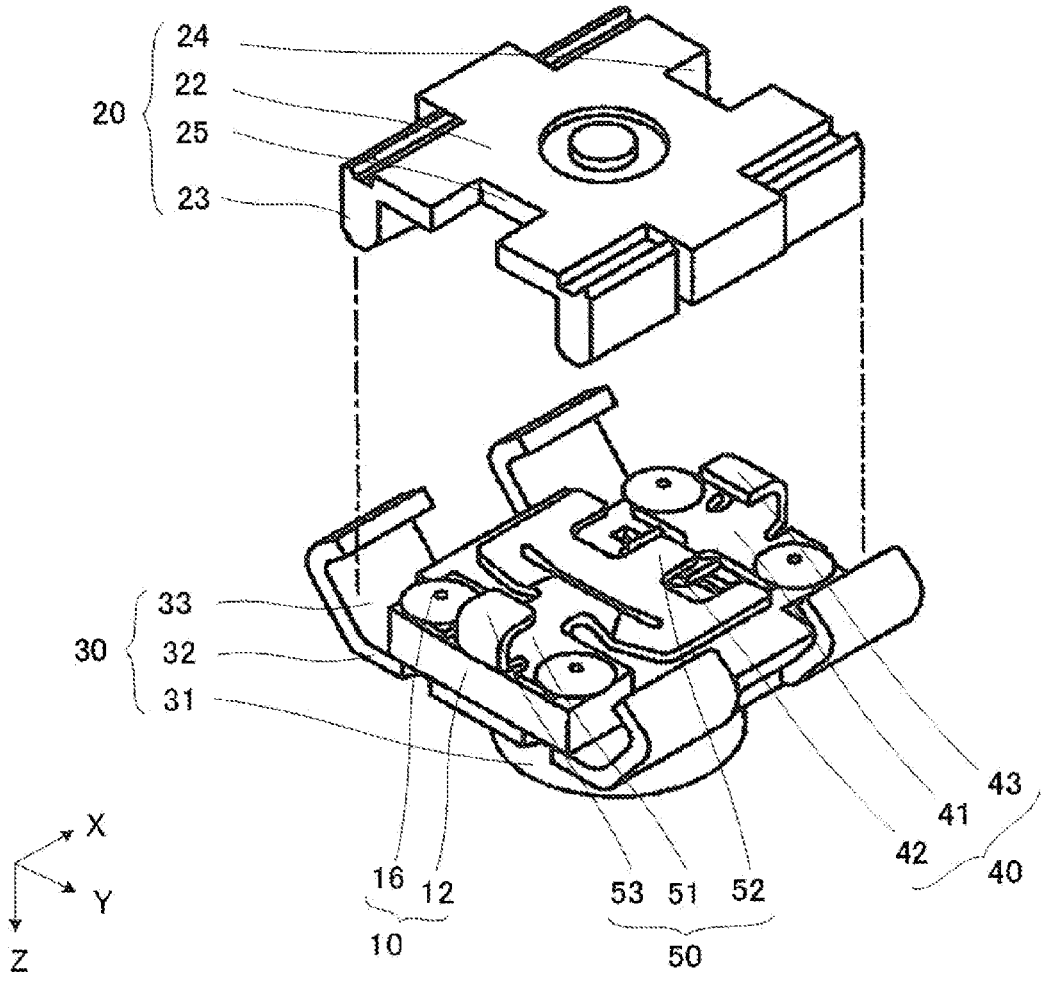
FIG. 9 is a perspective view illustrating a step of the manufacturing method of the coaxial connector 1 of FIG. 1, illustrating the manner in which a fixed terminal 40, a movable terminal 50, and a second resin member 20 are attached to the unit illustrated in FIGS. 8(A) and 8(B).
Figure 10:
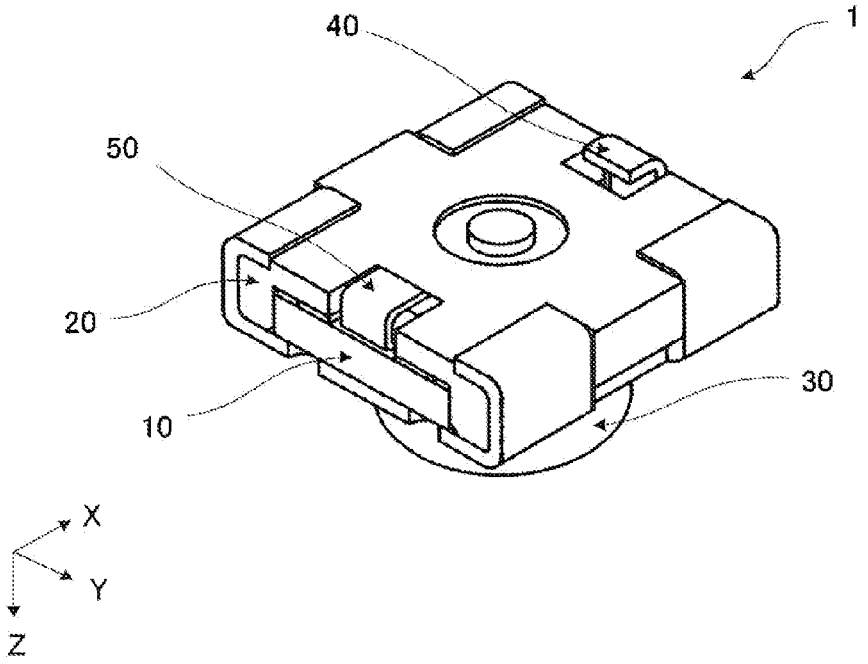
FIG. 10 is a perspective view of the coaxial connector 1 in an assembled state, illustrating the coaxial connector 1 of FIG. 1 viewed from the bottom side.

As illustrated in FIGS. 5, 9, and 10, the coaxial connector 1 is manufactured by attaching the first resin member 10, the fixed terminal 40, the movable terminal 50, and the second resin member 20 to the external terminal 30, which serves as a base.

Therefore, in FIGS. 5, 9, and 10, the positive and negative directions of the Z and Y axes are inverted from those in FIGS. 1 to 4 (see the arrows showing the axial directions in each figure).

Figure 6A:
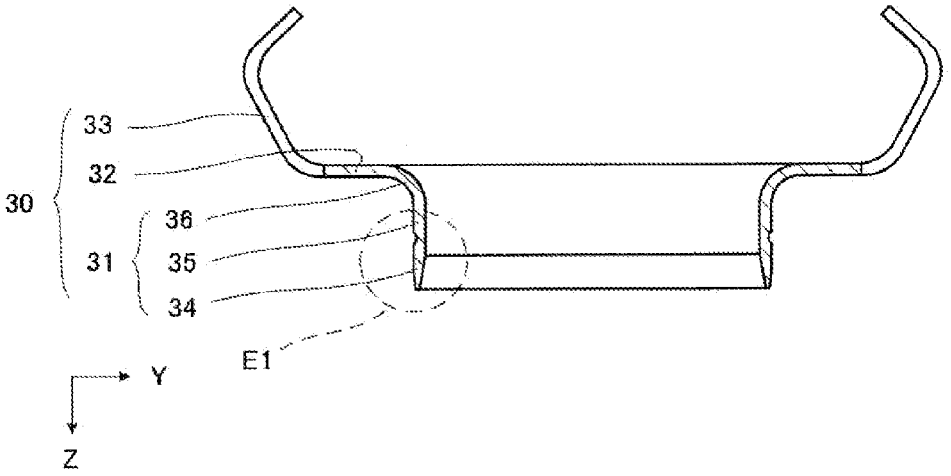
FIGS. 6(A) and 6(B) show sectional views of the external terminal 30 illustrated in FIG. 5.
Figure 6B:
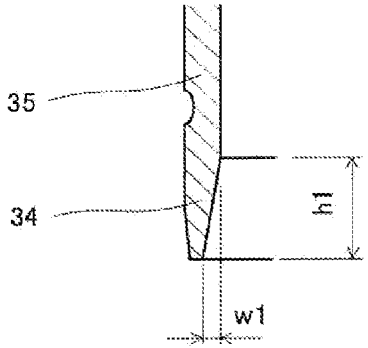

The external terminal 30, which serves as a base, is illustrated in FIGS. 5, 6(A), and 6(B).

The external terminal 30 includes a flat portion 32 that is flat, a cylindrical accommodating portion 31 provided at the center of the flat portion 32, and bendable leg portions 33 disposed at opposite sides of the flat portion 32.

A projecting portion 11 of the first resin member 10, which will be described below, is accommodated in the accommodating portion 31. The accommodating portion 31 has a bottomless cylindrical shape so that the accommodating portion 31 does not cover a through hole 13 in the projecting portion 11 of the first resin member 10.

The external terminal 30 is formed in advance by punching, bending, deep drawing, or die forming by using a metal plate made of brass or phosphor bronze for springs. The surface of the external terminal 30 is plated as necessary.

FIG. 6(A) is a sectional view of the external terminal 30 illustrated in FIG. 5 taken along a YZ plane. FIG. 6(B) is an enlarged view of part E1 illustrated in FIG. 6(A).

The accommodating portion 31 includes a linear side wall portion 35 that is bent at a right angle with respect to the flat portion 32 (in the Z direction), a curved portion 36 that connects the flat portion 32 to the side wall portion 35, and a terminal engagement portion 34 provided at an end of the side wall portion 35.

The terminal engagement portion 34 is a slope, and is formed in an annular shape on the inner side of the accommodating portion 31 at an end thereof. The terminal engagement portion 34 engages with a resin engagement portion 14 of the first resin member 10, which will be described below. As a result, the first resin member 10 is not easily pulled out in the Z direction.

The slope of the terminal engagement portion 34 is formed by forming the accommodating portion 31 into a straight shape first, and then pressing the accommodating portion 31 with a die having a slope. The slope height h1 is, for example, 0.1 mm to 0.4 mm, and the slope width w1 is, for example, 0.01 mm to 0.04 mm.

The height of the accommodating portion 31 is, for example, 0.3 mm. The outer diameter of the accommodating portion 31 is, for example, 1.1 mm, and the inner diameter of the accommodating portion 31 is, for example, 1.0 mm.

Figure 7A:
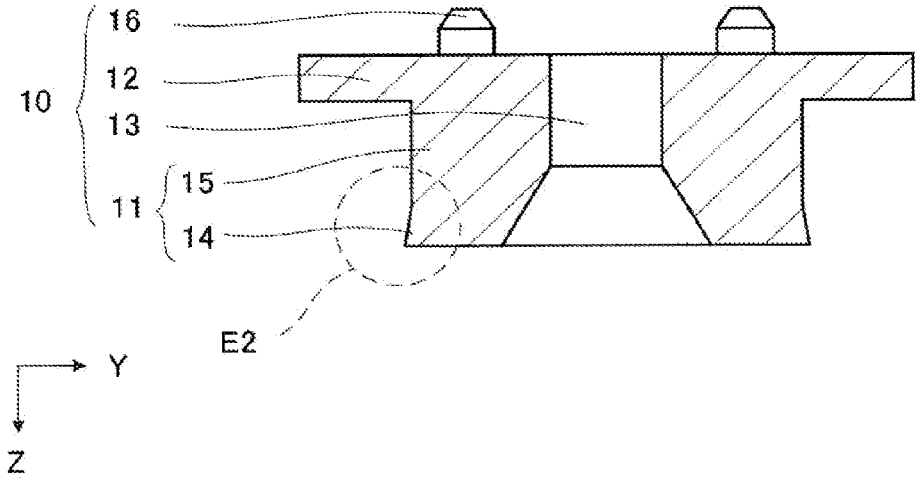
FIGS. 7(A) and 7(B) show sectional views of the first resin member 10 illustrated in FIG. 5.
Figure 7B:
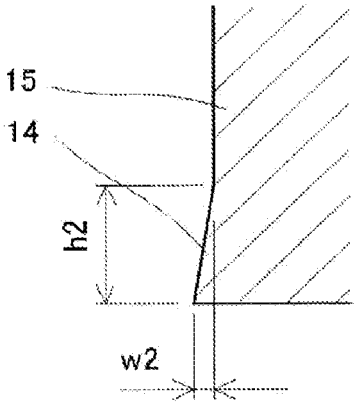

As illustrated in FIGS. 5, 7(A), and 7(B), the first resin member 10 includes a flat flange portion 12 and the projecting portion 11, which has a columnar shape and projects from the flange portion 12. The projecting portion 11 is accommodated in the above-described accommodating portion 31 of the external terminal 30.

The first resin member 10 has the through hole 13, which is circular and extends from an end of the projecting portion 11 to the bottom of the flange portion 12. The center conductor 95 of the mating coaxial connector 91 is inserted through the through hole 13. The opening at the end of the projecting portion 11 has a conical shape to facilitate the insertion of the center conductor 95 of the mating coaxial connector 91.

FIG. 7(A) is a sectional view of the first resin member 10 illustrated in FIG. 5 taken along a YZ plane. FIG. 7(B) is an enlarged view of part E2 illustrated in FIG. 7(A).

The projecting portion 11 includes a linear straight portion 15 that projects from the flange portion 12 at a right angle (in the Z direction) and a resin engagement portion 14 provided at an end of the straight portion 15.

The resin engagement portion 14 is a slope that is formed in an annular shape at the end of the projecting portion 11, and extends outward. The resin engagement portion engages with the above-described terminal engagement portion 34 of the external terminal 30.

Since the resin engagement portion 14 is a slope, the resin engagement portion 14 easily engages with the accommodating portion 31 of the external terminal 30, and the effect of preventing the separation is increased.

The first resin member 10 is formed by resin molding by using a mold (not shown). The slope height h2 of the resin engagement portion 14 is, for example, 0.1 mm to 0.4 mm, and the slope width w2 is, for example, 0.01 mm to 0.04 mm. The dimensions of the slope of the resin engagement portion 14 are slightly smaller than or equal to the dimensions of the slope of the terminal engagement portion 34.

The height of the projecting portion 11 is, for example, 0.35 mm, and the outer diameter of the projecting portion 11 is, for example, 1.0 mm. The outer diameter of the straight portion 15 is slightly smaller than or equal to the inner diameter of the side wall portion 35 of the accommodating portion 31.

The step of attaching the first resin member 10 to the external terminal 30 will be described with reference to FIGS. 5 to 7 and 8(A).

As illustrated in FIG. 5, first, the external terminal 30 is disposed so that the accommodating portion 31 of the external terminal 30 faces downward and the leg portions 33 extend upward. Also, the first resin member 10 is disposed above the external terminal 30 so that the projecting portion 11 of the first resin member 10 faces downward and the flange portion 12 faces upward.

Next, the first resin member 10 is fitted to the external terminal 30 in the direction shown by arrow Q while the orientations of the first resin member 10 and the external terminal 30 are maintained. At this time, the first resin member 10 is fitted to the external terminal 30 by being guided by the curved portion 36 at the entrance of the accommodating portion 31 of the external terminal 30.

If the entrance of the accommodating portion 31 is right-angled, since the resin engagement portion 14 of the first resin member 10 is an outwardly extending slope, the resin engagement portion 14 will interfere with the accommodating portion 31 at the entrance.

When the entrance of the accommodating portion 31 is curved, as illustrated in FIG. 6(A), the resin engagement portion 14 moves along the surface of the curved portion 36. Accordingly, the projecting portion 11 of the first resin member 10 moves in the fitting direction (Z direction) while being elastically deformed in the radial direction, and is inserted into the accommodating portion 31 of the external terminal 30.

Figure 8A:
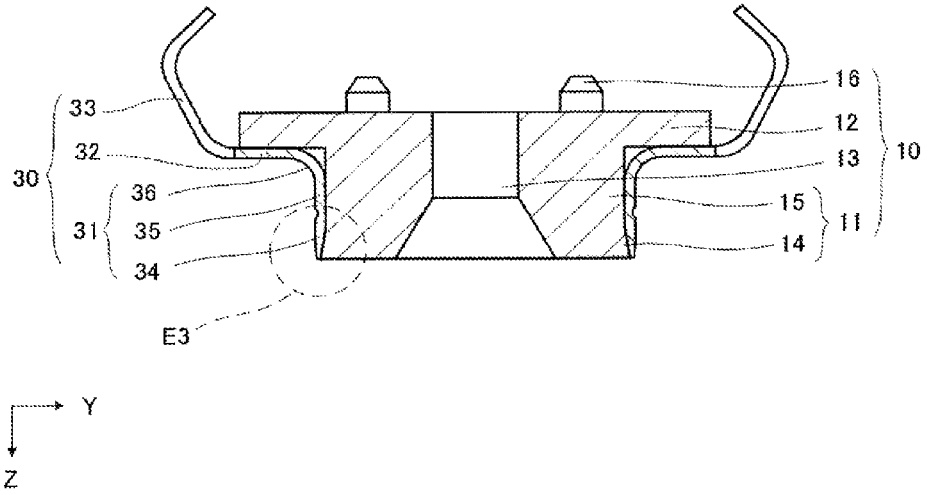
FIGS. 8(A) and 8(B) show sectional views illustrating the state in which the first resin member 10 of FIGS. 7(A) and 7(B) is accommodated in the external terminal 30 illustrated in FIGS. 6(A) and 6(B).
Figure 8B:
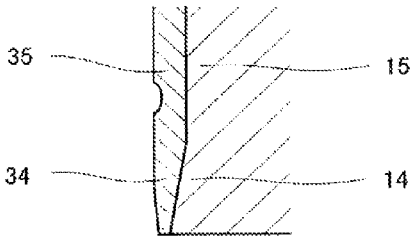

FIG. 8(A) is a sectional view illustrating the state in which the first resin member 10 is accommodated in the accommodating portion 31 of the external terminal 30. FIG. 8(B) is an enlarged view of part E3 illustrated in FIG. 8(A).

In this state, the flange portion 12 of the first resin member 10 is in contact with the flat portion 32 of the external terminal 30, and the straight portion 15 of the first resin member 10 is in contact with the side wall portion 35 of the external terminal 30.

In addition, as illustrated in FIG. 8(B), the resin engagement portion 14 of the first resin member 10 is engaged with the accommodating portion 31 of the external terminal 30. More specifically, the resin engagement portion 14 extends outward, and is engaged with the terminal engagement portion 34 of the accommodating portion 31.

Accordingly, even when vibration or the like is externally applied and a force is applied in a direction opposite to the fitting direction as a result, the first resin member 10 can be prevented from being separated from the external terminal 30.

The terminal engagement portion 34 is formed in advance in a shape that matches the shape of the resin engagement portion 14. Since the surface of the terminal engagement portion 34 matches the surface of the resin engagement portion 14, the engagement area is increased, and the separation prevention effect is increased accordingly.

Additional structures of the present embodiment will be described with reference to FIG. 5. As illustrated in FIG. 5, the external terminal 30 has a plurality of terminal dents 37 in the flat portion 32.

The dimensions of each terminal dent 37 in the X direction, Y direction, and Z direction (depth direction) are, for example, 0.2 mm, 0.4 mm, and 0.05 mm, respectively. The first resin member 10 includes a plurality of resin projections 17 on the flange portion 12.

The positions of the terminal dents 37 correspond to the positions of the resin projections 17. When the first resin member 10 is attached to the external terminal 30, the resin projections 17 are inserted into the respective terminal dents 37.

Thus, movement of the first resin member 10 in a rotational direction along an XY plane is restricted. Accordingly, even when vibration or the like is externally applied and a force is applied in the rotational direction as a result, the first resin member 10 is prevented from being rotated with respect to the external terminal 30.

The region in which the terminal dents 37 are formed in the external terminal 30 is not limited to the flat portion 32, and may be any region other than the accommodating portion 31. In addition, the dents and the projections may be switched so that terminal projections are formed on the external terminal 30 and resin dents are formed in the first resin member 10.

Although a manufacturing method in which the first resin member 10 is fitted to the external terminal 30 has been described, the manufacturing method is not limited to this. The first resin member 10 may instead be formed by insert molding by using the external terminal 30 as an insert member.

More specifically, the structure illustrated in FIGS. 8(A) and 8(B) may be formed by insert molding. In an example of a method for manufacturing the structure by insert molding, the external terminal 30 is held by another metal terminal (not shown) and surrounded by a predetermined mold (not shown), and resin is injected into the mold.

When the first resin member 10 is formed by insert molding, the resin engagement portion 14 having a shape that matches the shape of the terminal engagement portion 34 can be formed with high accuracy. In addition, even when the outer dimensions of the external terminal 30 vary due to individual differences, the first resin member 10 can be formed in a shape that follows the shape of the external terminal 30. Therefore, the separation of the first resin member 10 can be reliably prevented.

When insert molding is performed, the first resin member 10 comes into tight contact with the external terminal 30. Therefore, it may be expected that the risk of separation of the first resin member 10 can be reduced. However, in practice, the adhesive force decreases since the resin member contracts in a process of cooling the resin member. Therefore, even when insert molding is performed, it is effective to form the resin engagement portion 14 on the first resin member 10.

In the state in which the first resin member 10 is attached to the external terminal 30, the steps described below are performed. Although the external terminal 30 in which the first resin member 10 is accommodated is transported between the steps, the separation of the first resin member 10 does not occur since the resin engagement portion 14 is engaged with the accommodating portion 31 of the external terminal 30, as described above.

As illustrated in FIG. 9, first, the fixed terminal 40 and the movable terminal 50 are placed on the first resin member 10, and then are attached to the first resin member 10.

The fixed terminal 40 includes a fixed contact portion 42 that serves as a point of contact with the movable terminal 50, which will be described below, a fixed portion 41 disposed between the first resin member 10 and the second resin member 20, and a fixed-side lead portion 43 that is bent toward the second resin member 20.

The fixed terminal 40 is made of a metal plate, and is formed in advance by punching or bending. The fixed terminal 40 is placed on the first resin member 10, and is then attached to the first resin member 10 by thermally deforming resin pins 16 of the first resin member 10 with a heating jig (not shown).

The movable terminal 50 includes a movable contact portion 52 capable of coming into contact with and separating from the fixed terminal 40, a fixed portion 51 disposed between the first resin member 10 and the second resin member 20, and a movable-side lead portion 53 that is bent toward the second resin member 20.

The movable terminal 50 is made of an elastic metal plate, and is formed in advance by punching or bending. The movable terminal 50 is also attached to the first resin member 10 by using a heating jig.

Next, the second resin member 20 is disposed so to cover one end of the through hole 13 in the first resin member 10 from above the fixed terminal 40 and the movable terminal 50. Thus, the first resin member 10 and the second resin member 20 form an insulating casing. The fixed terminal 40 and the movable terminal 50 are disposed in the insulating casing.

The second resin member 20 includes a flat-plate-shaped resin cover portion 22 and resin guides 23 provided at the four corners of the resin cover portion 22. The resin guides 23 are guides for positioning the first resin member 10 and the second resin member 20.

To prevent the second resin member 20 from being separated, separation prevention structures, such as slopes, may be provided on the resin guides 23 or the first resin member 10 at certain positions.

Rectangular cuts 24 and 25 are formed in opposite side surfaces of the resin cover portion 22. The fixed-side lead portion 43 of the fixed terminal 40 is inserted through one cut 24, and the movable-side lead portion 53 of the movable terminal 50 is inserted through the other cut 25.

Lastly, the leg portions 33 of the external terminal 30 are bent toward the bottom side of the second resin member 20, and are fixed by crimping. As a result, as illustrated in FIG. 10, the external terminal 30 is attached to outer peripheries of the first resin member 10 and the second resin member 20 so as to surround the first resin member 10 and the second resin member 20, and manufacture of the coaxial connector 1 is completed.

In the present embodiment, the positions and shapes of the resin engagement portion 14 and the terminal engagement portion 34 can be changed arbitrarily. FIGS. 11 to 14 illustrate typical modifications.

Figure 11:
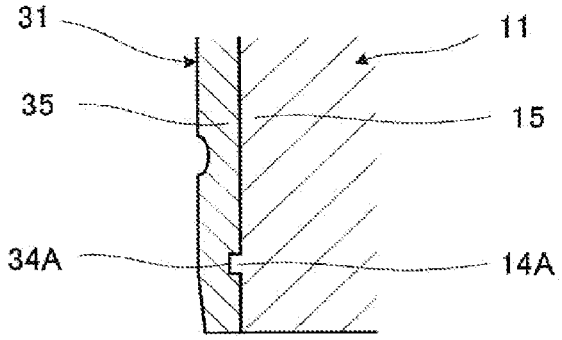
FIG. 11 illustrates a first modification of a resin engagement portion 14 and a terminal engagement portion 34 illustrated in FIGS. 8(A) and 8(B).

FIG. 11 illustrates a first modification of the resin engagement portion 14 and the terminal engagement portion 34 illustrated in FIG. 8(B).

A resin engagement portion 14A is a projection on the outer peripheral surface of the projecting portion 11, and has a rectangular-step-shaped cross section. A terminal engagement portion 34A is a recess in the inner peripheral surface of the accommodating portion 31, and also has a rectangular-step-shaped cross section. Preferably, each of the resin engagement portion 14A and the terminal engagement portion 34A is formed in an annular shape.

In the first modification, the step of the resin engagement portion 14A engages with the step of the terminal engagement portion 34A to prevent the separation of the first resin member 10.

Figure 12:
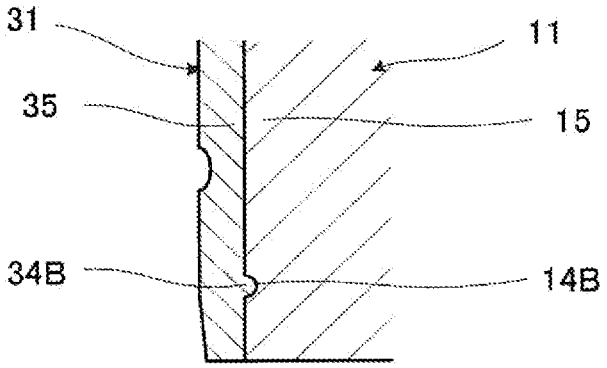
FIG. 12 illustrates a second modification of the resin engagement portion 14 and the terminal engagement portion 34 illustrated in FIGS. 8(A) and 8(B).

FIG. 12 illustrates a second modification of the resin engagement portion 14 and the terminal engagement portion 34 illustrated in FIG. 8(B).

A resin engagement portion 14B is a recess in the outer peripheral surface of the projecting portion 11, and has an arc-step-shaped cross section. A terminal engagement portion 34B is a projection on the inner peripheral surface of the accommodating portion 31, and also has an arc-step-shaped cross section. Preferably, each of the resin engagement portion 14B and the terminal engagement portion 34B is formed in an annular shape.

In the second modification, the step of the resin engagement portion 14B engages with the step of the terminal engagement portion 34B to prevent the separation of the first resin member 10.

Figure 13:
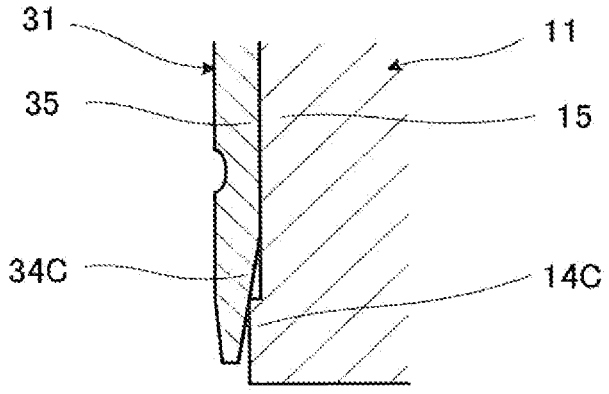
FIG. 13 illustrates a third modification of the resin engagement portion 14 and the terminal engagement portion 34 illustrated in FIGS. 8(A) and 8(B).

FIG. 13 illustrates a third modification of the resin engagement portion 14 and the terminal engagement portion 34 illustrated in FIG. 8(B).

A resin engagement portion 14C projects outward from the outer peripheral surface of the projecting portion 11 at an end of the projecting portion 11, and has a rectangular-step-shaped cross section. A terminal engagement portion 34C is a slope on the inner peripheral surface of the accommodating portion 31, the slope extending outward toward the end of the accommodating portion 31. Preferably, the resin engagement portion 14C is formed in an annular shape.

In the third modification, the step of the resin engagement portion 14C engages with the slope of the terminal engagement portion 14C to prevent the separation of the first resin member 10.

Figure 14:
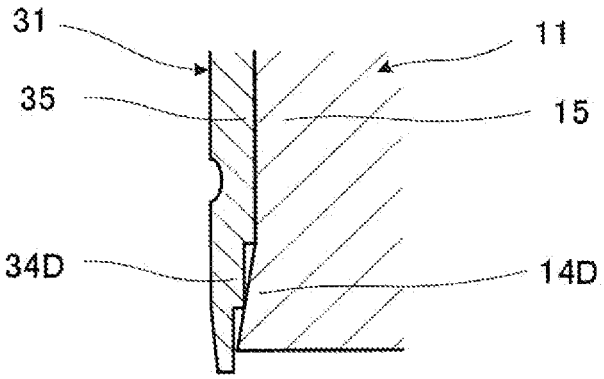
FIG. 14 illustrates a fourth modification of the resin engagement portion 14 and the terminal engagement portion 34 illustrated in FIGS. 8(A) and 8(B).
Figure 15:
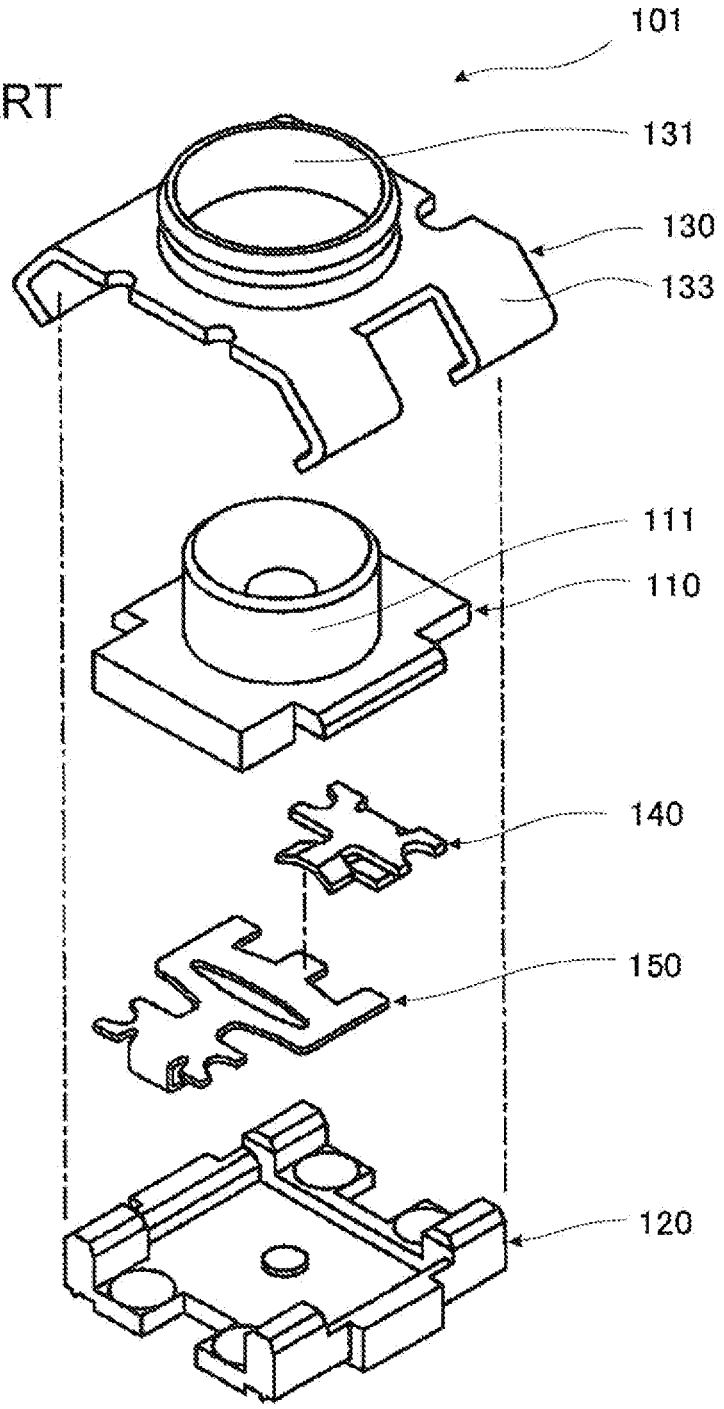
FIG. 15 PRIOR ART
FIG. 15 is an exploded perspective view of a coaxial connector 101 according to Japanese Unexamined Patent Application Publication No. 2002-42991.

FIG. 14 illustrates a fourth modification of the resin engagement portion 14 and the terminal engagement portion 34 illustrated in FIG. 8(B).

A resin engagement portion 14D is a slope on the outer peripheral surface of the projecting portion 11, the slope extending outward toward an end of the projecting portion 11. A terminal engagement portion 34D includes cuts formed in the inner peripheral surface of the accommodating portion 31 at an end of the accommodating portion 31, and has a step-shaped cross section. Preferably, the terminal engagement portion 34D is formed in an annular shape.

In the fourth modification, the slope of the resin engagement portion 14D engages with the steps of the terminal engagement portion 34D to prevent the separation of the first resin member 10.

The coaxial connector according to the present disclosure is not limited to coaxial connectors having the structures described in the present embodiment or to coaxial connectors manufactured by the manufacturing method described in the present embodiment, and various modifications are possible within the scope of the present disclosure.

For example, the first resin member 10 may be fitted to the external terminal 30 after the fixed terminal 40 and the movable terminal 50 are attached to the first resin member 10. Alternatively, the first resin member 10 and the second resin member 20 may be integrally formed as a unit by injecting a resin into a mold by using the fixed terminal 40 and the movable terminal 50 as insert members, and then the unit may be fitted to the external terminal 30.

In the first to fourth modifications, the shapes of the resin engagement portion and the terminal engagement portion may be switched. For example, in the first modification, the resin engagement portion 14A may be formed in a step shape by forming a recess in the outer peripheral surface of the projecting portion 11, and the terminal engagement portion 34A may be formed in a step shape by forming a projection on the inner peripheral surface of the accommodating portion 31.

The invention claimed is:

1. A coaxial connector comprising:

a first resin member having a through hole for receiving a center conductor of a mating coaxial connector;

a second resin member attached to the first resin member so as to cover one end of the through hole;

a fixed terminal disposed between the first resin member and the second resin member;

a movable terminal disposed between the first resin member and the second resin member, the movable terminal being capable of coming into contact with and separating from the fixed terminal; and an external terminal attached to outer peripheries of the first resin member and the second resin member without covering the other end of the through hole so as to be electrically connectable to an outer conductor of the mating coaxial connector, wherein the external terminal includes a cylindrical accommodating portion that accommodates the first resin member, the cylindrical accommodating portion includes a terminal engagement portion at an end thereof, and the terminal engagement portion includes a slope that is formed in an annular shape on the inner side of the cylindrical accommodating portion at the end thereof, and wherein the first resin member includes a resin engagement portion that is engaged with the cylindrical accommodating portion.

2. The coaxial connector according to claim 1, wherein the first resin member further includes a projecting portion, and the resin engagement portion includes a slope that is formed in an annular shape at the end of the projecting portion, and the resin engagement portion extends outward.

3. The coaxial connector according to claim 1, wherein the external terminal includes a terminal engagement portion at a position where the resin engagement portion is engaged, the terminal engagement portion having a shape that matches a shape of the resin engagement portion.

4. The coaxial connector according to claim 1, wherein the external terminal includes a terminal dent or a terminal projection in a region other than the accommodating portion, and wherein the first resin member includes a resin projection that matches the terminal dent or a resin dent that matches the terminal projection at a position corresponding to the terminal dent or the terminal projection.

5. The coaxial connector according to claim 1, wherein the first resin member is formed by insert molding by using the external terminal as an insert member.

6. The coaxial connector according to claim 1, wherein the resin engagement portion includes a step.

* * * * *